US010968822B2

(12) United States Patent
Kramer

(10) Patent No.: US 10,968,822 B2
(45) Date of Patent: Apr. 6, 2021

(54) LINEAR PISTON ENGINE FOR OPERATING EXTERNAL LINEAR LOAD

(71) Applicant: Franz Kramer, Kitchener (CA)

(72) Inventor: Franz Kramer, Kitchener (CA)

(73) Assignee: 470088 Ontario Limited, Kitchener (CA)

( * ) Notice: Subject to any disclaimer, the term of this patent is extended or adjusted under 35 U.S.C. 154(b) by 254 days.

(21) Appl. No.: 15/539,020

(22) PCT Filed: Dec. 23, 2015

(86) PCT No.: PCT/CA2015/051368

§ 371 (c)(1),
(2) Date: Jun. 22, 2017

(87) PCT Pub. No.: WO2016/101078

PCT Pub. Date: Jun. 30, 2016

(65) Prior Publication Data

US 2017/0370282 A1 Dec. 28, 2017

Related U.S. Application Data

(60) Provisional application No. 62/096,099, filed on Dec. 23, 2014.

(51) Int. Cl.
*F02B 75/28* (2006.01)
*F01B 23/10* (2006.01)
(Continued)

(52) U.S. Cl.
CPC ..... *F02B 75/287* (2013.01); *F01B 7/14* (2013.01); *F01B 23/10* (2013.01); *F02B 25/08* (2013.01);
(Continued)

(58) Field of Classification Search
CPC combination set(s) only.
See application file for complete search history.

(56) References Cited

U.S. PATENT DOCUMENTS 2,278,038 A 3/1942 Toce et al.
2,844,131 A 7/1958 Beveridge
(Continued)

FOREIGN PATENT DOCUMENTS

DE 952667 11/1956
GB 2026604 2/1980
(Continued)

OTHER PUBLICATIONS

Felix-Antoine Dandenault, International Search Report for PCT/CA2015/051368, dated Mar. 2, 2016.
(Continued)

*Primary Examiner* — David Hamaoui
*Assistant Examiner* — Ruben Picon-Feliciano
(74) *Attorney, Agent, or Firm* — Woods Oviatt Gilman LLP; Dennis B. Danella, Esq.

(57) ABSTRACT

A linear piston engine includes a housing having a combustion chamber located between opposing first and second piston chambers. A first piston assembly is located within the first piston chamber, and a second piston assembly is located within the second piston chamber. Each piston assembly includes a piston for reciprocating within the piston chamber. The piston is located adjacent to the combustion chamber. Each piston assembly also includes a crankshaft coupled to the piston for guiding the piston through a power stroke and a return stroke, and a linear output member coupled to the piston for providing a linear output motion based on reciprocating motion of the piston.

19 Claims, 2 Drawing Sheets

(51) Int. Cl.

| | |
|---|---|
| ***F01B 7/14*** | (2006.01) |
| ***F02B 63/04*** | (2006.01) |
| ***F02B 63/06*** | (2006.01) |
| ***F02B 25/08*** | (2006.01) |
| ***F01B 23/08*** | (2006.01) |

(52) U.S. Cl.
CPC ..... *F02B 63/041* (2013.01); *F02B 63/06* (2013.01); *F02B 75/28* (2013.01); *F01B 23/08* (2013.01)

(56) References Cited

U.S. PATENT DOCUMENTS

| | | | | |
|---|---|---|---|---|
| 2,853,963 | A | 9/1958 | Sawle, Jr. | |
| 2,910,973 | A * | 11/1959 | Witzky | F01B 7/14 123/48 B |
| 4,071,000 | A | 1/1978 | Herbert | |
| 4,216,747 | A | 8/1980 | Noguchi et al. | |
| 4,312,306 | A * | 1/1982 | Bundrick, Jr. | F01B 7/04 123/51 BA |
| 4,491,096 | A | 1/1985 | Noguchi et al. | |
| 4,535,730 | A * | 8/1985 | Allen | F02B 75/048 123/48 B |
| 5,799,629 | A * | 9/1998 | Lowi, Jr. | F01B 3/045 123/56.8 |
| 5,809,864 | A * | 9/1998 | Ashton | F01B 7/12 123/53.3 |
| 6,907,580 | B2 | 6/2005 | Michelman et al. | |
| 6,907,850 | B2 | 6/2005 | Creel | |
| 7,622,814 | B2 | 4/2009 | Hyde et al. | |
| 7,909,012 | B2 | 3/2011 | Pattakos et al. | |
| 2008/0178835 | A1 * | 7/2008 | Nelson | F01B 9/047 123/197.5 |
| 2009/0091138 | A1 | 4/2009 | Hyde et al. | |
| 2011/0146629 | A1 * | 6/2011 | Radocaj | F02B 75/282 123/51 R |
| 2013/0220281 | A1 | 8/2013 | Laimboeck | |

FOREIGN PATENT DOCUMENTS

| | | |
|---|---|---|
| WO | WO 99/20878 | 4/1999 |
| WO | 2014135198 | 9/2014 |

OTHER PUBLICATIONS

Tietje, Kai, "European Search Report", dated Sep. 6, 2018 for application No. EP 15871397.4, European Patent Office, Munich, Germany.

* cited by examiner

LINEAR PISTON ENGINE FOR OPERATING EXTERNAL LINEAR LOAD

CROSS-REFERENCE TO RELATED APPLICATIONS

This application is a National Stage filing under 35 U.S.C. § 371 of International Application No. PCT/CA2015/051368, filed Dec. 23, 2015, which in turn claims the benefit of U.S. Provisional Patent Application No. 62/096,099 filed on Dec. 23, 2014, the entire contents of which are hereby incorporated by reference herein for all purposes.

TECHNICAL FIELD

The embodiments disclosed herein relate to engines, and, in particular to engines that operate external linear loads.

INTRODUCTION

The following paragraphs are not an admission that anything discussed in them is prior art or part of the knowledge of persons skilled in the art.

U.S. Pat. No. 7,909,012 (Pattakos et al.) discloses a pulling rod engine that includes a piston connected to a crankshaft via a connecting rod. The crankshaft is disposed between a wrist pin and a combustion chamber. Pattakos et al. also discloses a configuration with two opposed pistons positioned within a long central cylinder. The pistons have crowns on both ends. The distal crowns (away from engine's center) cooperate with one way valves to provide scavenging pumps or compressors at the edges of the engine. The other crowns (near the center of the engine) form a combustion chamber.

U.S. Patent Application No. 2013/0220281 (Laimboeck) discloses a method for the reverse scavenging of an engine cylinder and for the introduction of fresh gas into the cylinder and for the discharge of exhaust gas out of the cylinder. The cylinder has oppositely disposed and opposingly driven pistons. In the region of the respective bottom dead center (BDC) of the two pistons, there are formed in the cylinder wall in each case one outlet region for the exhaust gas and in each case one, in particular circumferentially opposite flow transfer region for pre-compressed fresh gas which has been admitted from the crankcase. The fresh gas supplied through the respective flow transfer region is expelled in the direction of the wall region which is situated on that side of the cylinder inner wall and which adjoins the flow transfer region in the cylinder longitudinal direction.

SUMMARY

According to some embodiments, there is a linear piston engine that includes a housing having a combustion chamber located between opposing first and second piston chambers. A first piston assembly is located within the first piston chamber. The first piston assembly includes a first piston for reciprocating within the first piston chamber. The first piston is located adjacent to the combustion chamber. The first piston assembly also includes a first crankshaft coupled to the first piston for guiding the first piston through a power stroke and a return stroke, and a first linear output member coupled to the piston for providing a first linear output motion based on reciprocating motion of the first piston. A second piston assembly is located within the second piston chamber. The second piston assembly includes a second piston for reciprocating within the second piston chamber.

The second piston is located adjacent to the combustion chamber. The second piston assembly also includes a second crankshaft coupled to the second piston for guiding the second piston through a power stroke and a return stroke, and a second linear output member coupled to the piston for providing a second linear output motion based on reciprocating motion of the second piston.

At least one of the pistons may be coupled to an external linear load without intermediate connection to the crankshaft. The linear piston engine may include a first linear pump coupled to the first linear output member for providing the first linear output motion without intermediate connection to the first crankshaft. The linear piston engine may include a second linear pump coupled to the second linear output member for providing the second linear output motion without intermediate connection to the second crankshaft.

The first linear output motion may be parallel with the reciprocating motion of the first piston. The second linear output motion may be parallel with the reciprocating motion of the second piston. The reciprocating motion of the first and second pistons may be parallel.

Each linear output member may be a curved member that curves around the respective crankshaft. Each linear output member may be a straddle-mounted member that straddles the respective crankshaft.

The first crankshaft may be rotatably coupled to the second crankshaft. For example, the linear piston engine may include a gear train for rotatably coupling the first crankshaft to the second crankshaft.

The first and second crankshafts may be counter-rotating.

Each piston assembly may include a flywheel rotatably coupled to the respective crankshaft.

The first and second piston chambers may be linearly aligned.

Each piston may be pivotally coupled to the respective linear output member. As an example, the first piston assembly may include a first connecting rod pivotally coupled to the first piston and pivotally coupled to the first crankshaft for rotating the first crankshaft based on reciprocating motion of the first piston. As another example, the second piston assembly may include a second connecting rod pivotally coupled to the second piston and pivotally coupled to the second crankshaft for rotating the second crankshaft based on reciprocating motion of the second piston.

According to some embodiments, there is a linear piston engine that includes a housing having a combustion chamber located between opposing first and second piston chambers. A first piston assembly is located within the first piston chamber, and a second piston assembly located within the second piston chamber. Each of the piston assemblies includes a piston for reciprocating within the piston chamber. The piston is located adjacent to the combustion chamber. Each of the piston assemblies also includes a crankshaft coupled to the piston for guiding the piston through a power stroke and a return stroke, and a linear output member coupled to the piston for providing a linear output motion based on reciprocating motion of the piston.

Each piston may be coupled to an external linear load without intermediate connection to the crankshaft.

According to some embodiments, there is a linear piston engine that includes a housing having a combustion chamber and a piston chamber. A piston assembly is located within the piston chamber. The piston assembly includes a piston for reciprocating within the piston chamber. The piston being located adjacent to the combustion chamber. The piston assembly also includes a crankshaft coupled to the piston for guiding the piston through a power stroke and a return stroke, and a linear output member coupled to the piston for providing a linear output motion based on reciprocating motion of the piston.

The piston may be coupled to an external linear load without intermediate connection to the crankshaft.

Other aspects and features will become apparent, to those ordinarily skilled in the art, upon review of the following description of some exemplary embodiments.

BRIEF DESCRIPTION OF THE DRAWINGS

The drawings included herewith are for illustrating various examples of articles, methods, and apparatuses of the present specification. In the drawings.

DETAILED DESCRIPTION

Various apparatuses or processes will be described below to provide an example of each claimed embodiment. No embodiment described below limits any claimed embodiment and any claimed embodiment may cover processes or apparatuses that differ from those described below. The claimed embodiments are not limited to apparatuses or processes having all of the features of any one apparatus or process described below or to features common to multiple or all of the apparatuses described below. It is possible that an apparatus or process described below is not covered by any of the claimed embodiments. Any embodiment disclosed below that is not claimed in this document may be the subject matter of another protective instrument, for example, a continuing patent application, and the applicants, inventors or owners do not intend to abandon, disclaim or dedicate to the public any such embodiment by its disclosure in this document.

Figure 1:
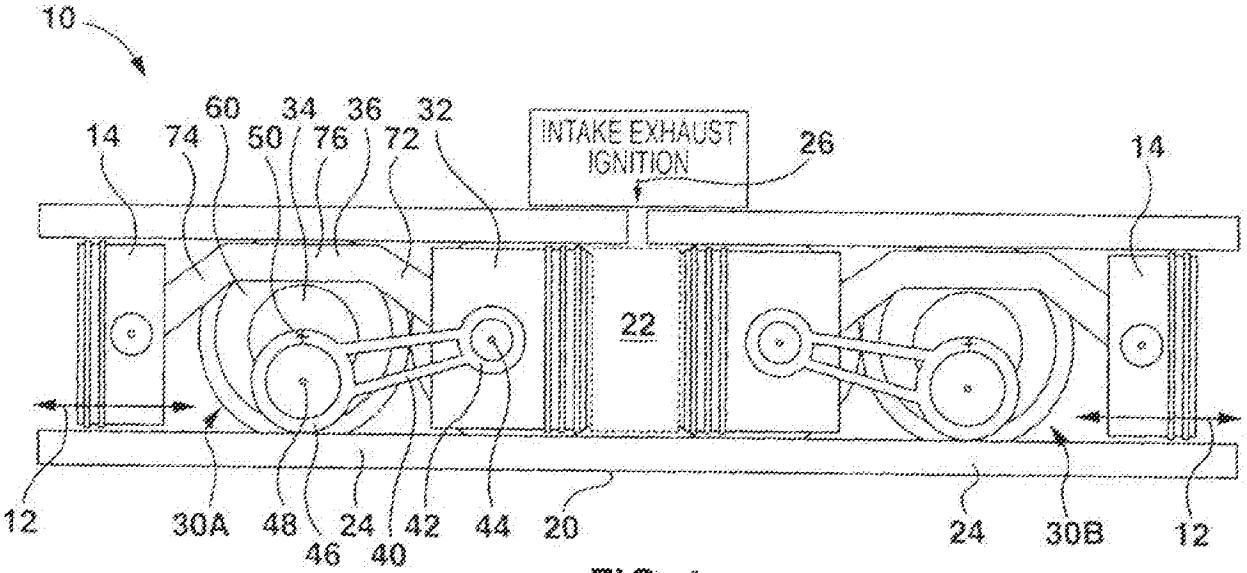
FIG. 1 is a cross-section elevational view of a linear piston engine according to one embodiment.
Figure 2:
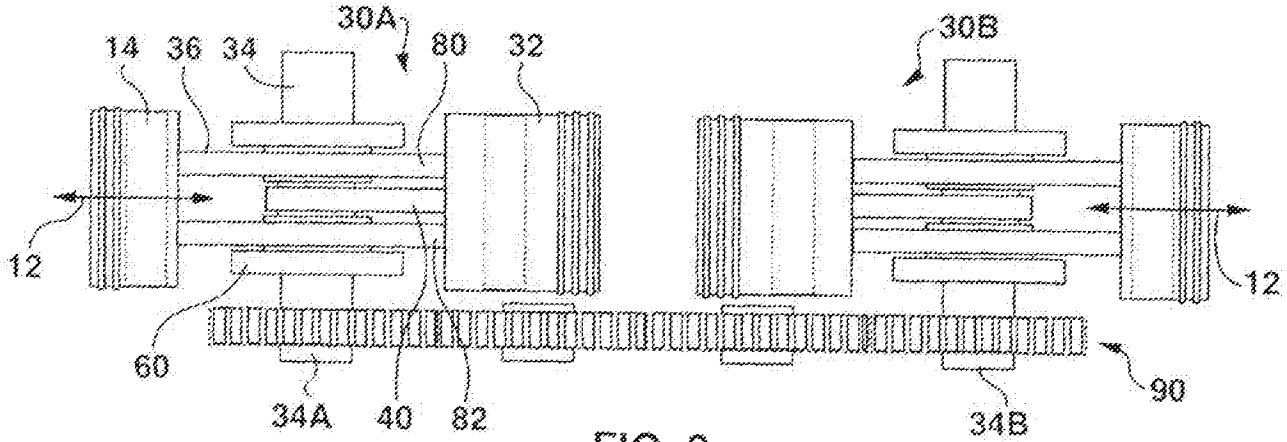
FIG. 2 is a top plan view of the linear piston engine of FIG. 1 with a housing omitted for clarity.

Referring to FIGS. 1 and 2, illustrated therein is a linear piston engine 10 for producing linear output motion 12. As shown in FIG. 1, there are two linear outputs (i.e. one on each side of the linear piston engine 10). As shown, the linear output motion 12 may be used to drive a linear pump 14. In other embodiments, the linear output motion 12 may be used to operate a linear electrical power generator, or another type of external linear load that relies on linear motion (e.g. instead of rotary motion).

The linear piston engine 10 includes a housing 20 having a combustion chamber 22 located between two opposing piston chambers 24. A first piston assembly 30A is located within the first piston chamber 24, and a second piston assembly 30B is located within the second piston chamber 24. The piston assemblies 30A. 30B may be used to drive one or more external linear loads such as the two linear pumps 14. In some embodiments, there may be a single external linear load coupled to one piston assembly 30A, and the other piston assembly 30B may have no load. There could also be multiple external linear loads driven by each piston assembly.

The piston assemblies 30A. 30B may have similar configurations (e.g. mirror images of each other). For example, each piston assembly 30A, 30B may include a piston 32 for reciprocating within the piston chamber 24, a crankshaft 34 for guiding the piston 32 back and forth within the piston chamber 24, and a linear output member 36 for providing the linear output motion 12 based on reciprocating motion of the piston 32.

Each piston 32 may have a generally cylindrical shape. The pistons 32 may be made of metal such as steel, or another suitable material.

Each piston 32 is located within a respective piston chamber 24 adjacent to the combustion chamber 22. As described above, the piston 32 reciprocates back and forth within the piston chamber 24. For example, the piston 32 may move outwardly away from the combustion chamber 22 during a power stroke (e.g. after combustion), and the piston 32 may move inwardly toward the combustion chamber 22 during a return stroke (e.g. while releasing exhaust gases).

The combustion chamber 22 may change size as the pistons 32 reciprocate back and forth. For example, the combustion chamber 22 may expand during the power stroke, and contract during the return stroke.

There may be one or more openings 26 that lead to the combustion chamber 22. For example, the housing 20 may have one or more intake passageways (e.g. to allow combustion products to enter the combustion chamber 22). There may also be one or more exhaust passageways (e.g. to allow exhaust gases to leave the combustion chamber 22). In some embodiments, a single passageway may be used for intake and exhaust cycles (e.g. in cooperation with one or more intake control valves and/or exhaust control valves).

The crankshaft 34 is coupled to the piston 32. For example, each piston assembly 30A, 30B may include a connecting rod 40 pivotally coupled to the piston 32 and to the crankshaft 34. As shown, the connecting rod 40 may have a proximal end 42 pivotally coupled to the piston 32 at a first pivot point 44, and a distal end 46 pivotally coupled to the crankshaft 34 at a second pivot point 48. The second pivot point 44 is generally offset from a rotation axis 50 of the crankshaft 34. The offset may allow the crankshaft 34 to rotate in response to linear motion of the piston 32 as will be described below.

Figure 3A:
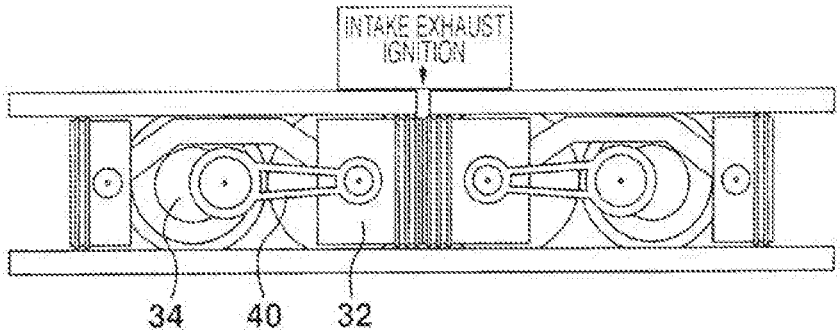
FIGS. 3A-3D are cross-section elevational views showing motion of the piston engine from top-dead-center (FIG. 3A), through a power stroke (FIG. 3B), to bottom-dead-center (FIG. 3C), and through a return stroke (FIG. 3D).

As shown in FIG. 3A, the crankshaft 34 may have an initial position, which may be referred to as top-dead-center (or "TDC"). At this point, the combustion chamber 22 may have its smallest size.

Figure 3B:
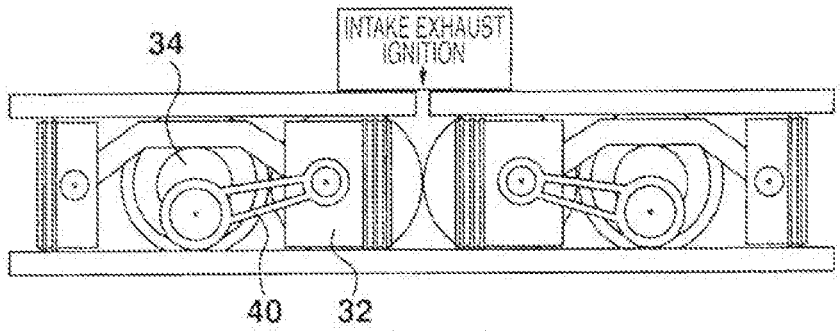

Upon ignition, combustion pressures may initiate a power stroke that forces both pistons 32 outwardly. During the power stroke, the crankshaft 34 may rotate clockwise through the 90-degree position from TDC as shown in FIG. 3B.

Figure 3C:
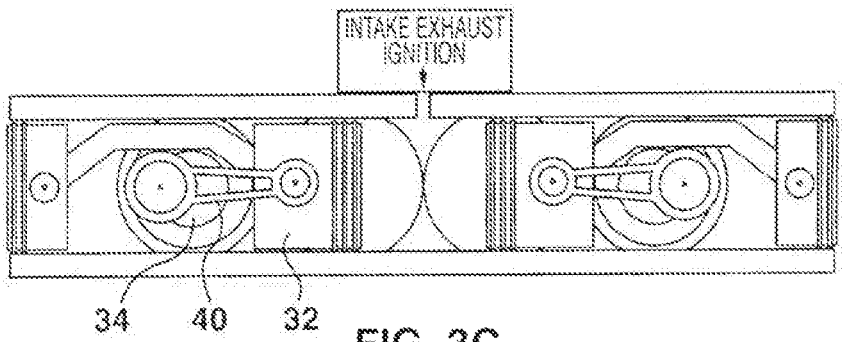

At the end of the power stroke, the combustion chamber 22 may be at its largest size (e.g. the pistons 32 may be separated by a maximum distance). At this point, the crankshaft 34 may have rotated 180-degrees from TDC (e.g. as shown in FIG. 3C). This position may be referred to as bottom-dead-center (or "BDC").

Figure 3D:
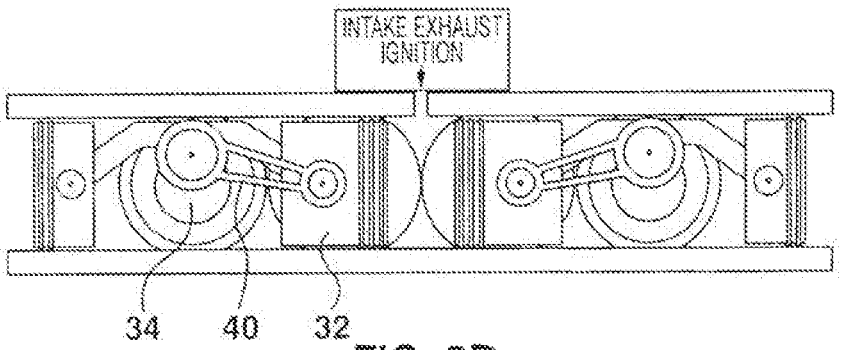

The pistons 32 may then move along a return stroke back toward the initial top-dead-center position. During the return stroke, the crankshaft 34 may rotate clockwise through the 270-degree position from TDC as shown in FIG. 3D.

As shown in FIGS. 3A-3D, the crankshaft 34 of the first piston assembly 30A may rotate clockwise, and the crankshaft of the second piston assembly 30B may rotate counterclockwise. In some embodiments, the crankshafts may rotate in other directions. For example, both crankshafts may rotate in the same direction (e.g. both rotate clockwise), or the directions may be reversed.

In general, rotation of the crankshafts 34 may help guide the pistons 32 back and forth through successive cycles. For example, the crankshaft 34 may initially start rotating during the power stroke. After completion of the power stroke, angular momentum of the rotating crankshaft 34 may help drive the piston 32 back for the return stroke. Without the crankshaft 34, the piston 32 might otherwise remain stationary at the BDC position.

In some embodiments, the linear piston engine 10 may include other mechanisms for guiding the piston 32 back and forth through the power stroke and return stroke. For example, pneumatics or other sources of fluid pressure may help drive the piston 32 back and forth. Springs or other biasing mechanisms could also be used.

Referring again to FIGS. 1 and 2, there may be a flywheel 60 coupled to the crankshaft 34. The flywheel 60 may be in the form of a circular disc. The flywheel 60 may have a moment of inertia, which may help increase angular momentum of the crankshaft 34. This may help drive the piston 32 back through the return stroke after completing the power stroke. In some cases, the flywheel 60 may help provide smooth operation of the linear piston engine 10.

Referring still to FIG. 1, the linear output member 36 is coupled to the piston 32 for operating the external linear load (e.g. the linear pump 14). For example, the linear output member 36 may have a proximal end 72 pivotally coupled to the piston 32 (e.g. at the first pivot point 44), and a distal end 76 pivotally coupled to the linear pump 14. Accordingly, reciprocating motion of the piston 32 is directly transferred to the linear pump 14 through the linear output member 36 (e.g. without intermediate connection to the crankshaft 34).

As shown, the linear output member 36 may be a curved member that curves around the crankshaft 34 (also referred to as a "concave member"). For example, the output member 36 has a mid-section 76, and the proximal end 72 may be bent towards the piston 32 (e.g. curved downward), and the distal end 74 may be bent toward the linear pump 14 (e.g. curved downward). Having curved members pivotally coupled to the piston 32 and linear pump 14 may be useful when motion of the piston 32 is inclined or offset relative to the linear pump 14.

With reference to FIG. 2, the linear output member 36 may be a straddle-mounted member that straddles the crankshaft 34. For example, the linear output member 36 may include two or more output portions 80, 82 that straddle the control rod 40 of the crankshaft 34.

While the illustrated embodiment shows the two output portions 80, 82 as curved members, in other embodiments, the output portions 80, 82 may have other configurations such as straight rods affixed between the piston 32 and the linear pump 14.

In the illustrated embodiment, the linear output motions 12 of each piston assembly 30A, 30B are parallel with each other. More particularly, the linear pumps 14 operate in a generally co-linear fashion. Moreover, the linear output motions 12 are parallel with reciprocating motion of the pistons 32. Furthermore, the piston chambers 24 are linearly aligned (e.g. co-linear).

In some embodiments, the linear output motions 12 may be inclined or offset relative to each other. Furthermore, the linear output motions 12 could be inclined or offset relative to motion of the pistons 32.

Referring now to FIG. 2, in some embodiments, the crankshafts 34 of the piston assemblies 30A, 30B may be rotatably coupled together. For example, there may be a gear train 90 for rotatably coupling the first crankshaft 34A to the second crankshaft 34B. This may help synchronize operation of the piston assemblies 30A, 30B. This may help provide smooth operation and/or may help reduce vibration.

It is also noted that having two opposing piston assemblies 30A, 30B can help balance the piston engine 10. More particularly, movement of one piston assembly 30A may mirror that of the other piston assembly 30B. In other words, the piston assemblies have symmetrical operation. This may help provide smooth operation and/or may help reduce vibration.

In the illustrated example, the gear train 90 includes four gears inter-engaged with each other. This gear configuration may allow the first crankshaft 34A to rotate in one direction (e.g. clockwise), while the second crankshaft 34B rotates in the opposite direction (e.g. counter-clockwise). In some embodiments, the gear train 90 may have other configurations such as three gears, which may allow the crankshafts to rotate in the same direction (e.g. both clockwise, or both counter-clockwise).

Some embodiments described herein, may allow direct transfer of linear forces from the pistons 32 to external linear loads such as linear pumps. This is in contrast to conventional rotary engines, which tend to convert energy from linear-to-rotary and then rotary-to-linear to drive external linear loads. With conventional rotary engines, these energy conversions may result in energy conversion losses, which may reduce system efficiency. One or more embodiments described herein may avoid or reduce these energy conversion losses, which may increase system efficiency.

For example, an exemplary linear piston engine was made in a similar fashion as described with respect to FIG. 1. The linear piston engine was coupled to a linear pump. Performance of the linear pump was compared between the exemplary linear piston engine and a conventional rotary engine in which energy was converted from linear-to-rotary and then rotary-to-linear. The exemplary linear piston engine had an increased efficiency of approximately 40% compared to the conventional rotary engine. It is believed that the increased efficiency was due to avoidance of a 20% energy loss resulting from linear-to-rotary energy conversion, and avoidance of another 20% energy loss resulting from rotary-to-linear energy conversion.

In some embodiments, it may be possible to reduce engine size using the linear piston engine. For example, the two opposing piston assemblies can have a similar displacement as a conventional rotary engine, but with half the piston velocity and half the stroke length. This may reduce mechanical forces on the piston assemblies (e.g. reduced side pressure) and may allow use of smaller and/or lighter components. This may also reduce friction and heat, which may allow operation at RPM compared to a convention rotary engine.

While some embodiments herein relate to a piston engine having two opposed piston assemblies, in other embodiments the piston engine may have one or more piston assemblies. For example, there may be a single piston assembly disposed within a single piston chamber adjacent to a combustion chamber.

As another example, there may be two or more piston assemblies mounted laterally adjacent to each other and coupled to a single crankshaft. Each piston assembly may be rotationally offset from the other piston assemblies. For example, there may be four piston assemblies coupled to a single crankshaft at 90-degree increments. This configuration may provide linear output motions for driving one or more external linear loads.

While the above description provides examples of one or more apparatus, methods, or systems, it will be appreciated that other apparatus, methods, or systems may be within the scope of the claims as interpreted by one of skill in the art.

The invention claimed is:

1. A linear piston engine comprising:

a) a housing having a combustion chamber located between opposing first and second piston chambers;

b) a first piston assembly located within the first piston chamber, the first piston assembly comprising:

i) a first piston for reciprocating within the first piston chamber, the first piston being located adjacent to the combustion chamber;

ii) a first crankshaft coupled to the first piston for guiding the first piston through a power stroke and a return stroke; and iii) a first linear output member coupled to the first piston for providing a first linear output motion based on reciprocating motion of the first piston; and wherein a first crankshaft concentric longitudinal axis of the first crankshaft intersects a first piston concentric longitudinal axis of the first piston at a first perpendicular angle, and c) a second piston assembly located within the second piston chamber, the second piston assembly comprising:

i) a second piston for reciprocating within the second piston chamber, the second piston being located adjacent to the combustion chamber;

ii) a second crankshaft coupled to the second piston for guiding the second piston through a power stroke and a return stroke; and iii) a second linear output member coupled to the second piston for providing a second linear output motion based on reciprocating motion of the second piston, and wherein a second crankshaft concentric longitudinal axis of the second crankshaft intersects a second piston concentric longitudinal axis of the second piston at a second perpendicular angle.

2. The linear piston engine of claim 1, wherein at least one of the pistons are coupled to an external linear load without intermediate connection to one of the first crankshaft or the second crankshaft.

3. The linear piston engine of claim 2, further comprising a first linear pump coupled to the first linear output member for providing the first linear output motion without intermediate connection to the first crankshaft.

4. The linear piston engine of claim 3, further comprising a second linear pump coupled to the second linear output member for providing the second linear output motion without intermediate connection to the second crankshaft.

5. The linear piston engine of claim 1, wherein the first linear output motion is parallel with the reciprocating motion of the first piston.

6. The linear piston engine of claim 5, wherein the second linear output motion is parallel with the reciprocating motion of the second piston.

7. The linear piston engine of claim 1, wherein reciprocating motion of the first and second pistons is parallel.

8. The linear piston engine of claim 1, wherein each linear output member is a curved member that curves around the respective crankshaft.

9. The linear piston engine of claim 1, wherein each linear output member is a straddle-mounted member that straddles the respective crankshaft.

10. The linear piston engine of claim 1, wherein the first crankshaft is rotatably coupled to the second crankshaft.

11. The linear piston engine of claim 10, further comprising a gear train for rotatably coupling the first crankshaft to the second crankshaft.

12. The linear piston engine of claim 1, wherein the first and second crankshafts are counter-rotating.

13. The linear piston engine of claim 1, wherein each piston assembly includes a flywheel rotatably coupled to the respective crankshaft.

14. The linear piston engine of claim 1, wherein the first and second piston chambers are linearly aligned.

15. The linear piston engine of claim 1, wherein each piston is pivotally coupled to the respective linear output member.

16. The linear piston engine of claim 1, wherein the first piston assembly comprises a first connecting rod pivotally coupled to the first piston and pivotally coupled to the first crankshaft for rotating the first crankshaft based on reciprocating motion of the first piston.

17. The linear piston engine of claim 1, wherein the second piston assembly comprises a second connecting rod pivotally coupled to the second piston and pivotally coupled to the second crankshaft for rotating the second crankshaft based on reciprocating motion of the second piston.

18. A linear piston engine comprising:

a) a housing having a combustion chamber located between opposing first and second piston chambers;

b) a first piston assembly located within the first piston chamber; and c) a second piston assembly located within the second piston chamber;

d) each of the first and second piston assemblies comprising:

i) a piston for reciprocating within the piston chamber, the piston being located adjacent to the combustion chamber;

ii) a crankshaft coupled to the piston for guiding the piston through a power stroke and a return stroke; and iii) a linear output member coupled to the piston for providing a linear output motion based on reciprocating motion of the piston wherein a crankshaft concentric longitudinal axis of the crankshaft intersects a piston concentric longitudinal axis of the piston at a perpendicular angle.

19. The linear piston engine of claim 18, wherein the piston is coupled to an external linear load without intermediate connection to the crankshaft.

* * * * *